US005158924A

United States Patent [19]

Konagaya et al.

[11] Patent Number: 5,158,924

[45] Date of Patent: Oct. 27, 1992

[54] REVERSIBLE THERMOSENSITIVE RECORDING MATERIAL AND IMAGE DISPLAY METHOD OF USING THE SAME

[75] Inventors: Yukio Konagaya, Shimizu; Yoshihiko Hotta, Mishima; Makoto Kawaguchi, Shizuoka; Toru Nogiwa; Kunichika Morohoshi, both of Numazu; Akira Suzuki, Mishima; Fumihito Masubuchi, Numazu; Takao Igawa, Tokyo, all of Japan

[73] Assignee: Ricoh Company, Ltd., Tokyo, Japan

[21] Appl. No.: 760,007

[22] Filed: Sep. 13, 1991

[30] Foreign Application Priority Data

| | | | |
|---|---|---|---|
| Sep. 14, 1990 | [JP] | Japan | 2-244270 |
| Sep. 14, 1990 | [JP] | Japan | 2-244271 |
| Nov. 26, 1990 | [JP] | Japan | 2-321721 |
| Mar. 12, 1991 | [JP] | Japan | 2-72303 |
| May 31, 1991 | [JP] | Japan | 2-155433 |
| Aug. 7, 1991 | [JP] | Japan | 3-222296 |
| Aug. 28, 1991 | [JP] | Japan | 3-242692 |

[51] Int. Cl.[5] ..... B41M 5/26; B41M 5/40

[52] U.S. Cl. ..... 503/201; 428/195; 428/409; 428/913; 503/209; 503/217; 503/225; 503/226

[58] Field of Search ..... 427/150–152; 503/214, 216, 217, 201, 209, 225; 428/195, 913, 914

*Primary Examiner*—B. Hamilton Hess

*Attorney, Agent, or Firm*—Oblon, Spivak, McClelland, Maier & Neustadt

[57] ABSTRACT

A reversible thermosensitive recording material is composed of a support and a reversible thermosensitive recording layer formed thereon, which is capable of recording and erasing images repeatedly by utilizing its property that the transparency can be changed reversibly from a transparent state to an opaque state, and vice versa, depending upon the temperature thereof. The reversible thermosensitive recording layer is composed of a reversible thermosensitive layer and a protective layer formed thereon and has a scratching intensity of 10 g or more and a coefficient of friction of 0.10 or less. Images are reversibly formed and erased on this reversible thermosensitive recording material.

15 Claims, 2 Drawing Sheets

REVERSIBLE THERMOSENSITIVE RECORDING MATERIAL AND IMAGE DISPLAY METHOD OF USING THE SAME

BACKGROUND OF THE INVENTION

1. Field of the Invention

The present invention relates to a reversible thermosensitive recording material capable of recording and erasing images repeatedly by utilizing its property that the transparency can be changed reversibly from a transparent state to an opaque state, and vice versa, depending upon the temperature thereof. The present invention also relates to an image display method using this reversible thermosensitive recording material.

2. Discussion of Background

As a reversible thermosensitive recording material which is capable of recording images and erasing the same repeatedly, a recording material provided with a thermosensitive recording layer comprising a resin such a polyvinyl chloride resin and an organic low-molecular material such as a higher fatty acid which is dispersed in the resin is disclosed, for instance, in Japanese Laid-Open Patent Application 55-154198. In order to prevent the deformation of the surface of such a recording material or to avoid a decrease in transparency of the recording material by the heat or pressure applied by a heat application means for image formation such as a thermal head, reversible thermo-sensitive recording materials provided with a protective layer comprising a heat resistant resin such as ultraviolet curing resin or electron-radiation curing resin are disclosed in Japanese Laid-Open Patent Applications 1-133781 and 2-566.

In the reversible thermosensitive recording materials provided with the protective layer comprising the above-mentioned heat resistant resin, the deformation of the surface thereof is small. However, when recording and erasing steps are repeated by use of a thermal head, in particular, on an identical portion of the recording material, the surface of the recording material is scratched by the thermal head, and part of the protective layer is peeled off the recording layer and adheres to the thermal head. When the peeled protective layer portion adheres to the thermal head and is built up thereon, or when some dust adheres to the surface of the thermosensitive recording material and such dust is built up between the thermal head and thermosensitive recording material with time, heat transfer from the thermal head to the recording material is hindered and eventually normal image formation becomes impossible, or image formation cannot be carried out in the portions where such dust is built up.

Furthermore, in order to prevent the sticking between the thermal head and the reversible thermosensitive recording material, reversible thermosensitive recording materials provided with a protective layer comprising as the main component a silicone rubber, a silicone resin, or a polysiloxane graft polymer are proposed, for instance, in Japanese Laid-Open Patent Applications 63-221087 and 63-317385. These recording materials, however, also have the problems that when images are formed repeatedly on an identical portion by a thermal head, the surface of each recording material is scratched because of the insufficiency of the hardness thereof or because the protective layer is peeled off the recording layer. As a result, image formation becomes impossible.

SUMMARY OF THE INVENTION

It is therefore an object of the present invention to provide a reversible thermosensitive recording material which is free from the problems of the conventional reversible thermosensitive recording media and is capable of yielding images with a uniform high quality even when image formation is continuously repeated at a number of times.

This object of the present invention is achieved by a reversible thermosensitive recording material comprising a support and a reversible thermosensitive recording layer formed thereon, which reversible thermosensitive recording layer comprises a reversible thermosensitive layer and a protective layer formed thereon and has a scratching intensity of 10 g or more and a coefficient of friction of 0.10 or less on the surface thereof.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The reversible thermosensitive recording material of the present invention can be switched from a transparent state to a milky white opaque state, and vice versa, depending on the temperature thereof. It is presumed that the difference between the transparent state and the milky white opaque state of the recording material is based on the following principle:

(i) In the transparent state, the organic low-molecular-weight material dispersed in the matrix resin consists of relatively large crystals, so that the light which enters the crystals from one side passes therethrough to the opposite side, without being scattered, thus the reversible thermosensitive recording material appears transparent.

(ii) In the milky white opaque state, the organic low-molecular-weight material is composed of polycrystals consisting of numerous small crystals, with the crystallographic axes pointed to various directions, so that the light which enters the recording layer is scattered a number of times on the interface of crystals of the organic low-molecular-weight material. As a result, the thermosensitive recording layer becomes opaque in a milky white color.

The transition of the state of the reversible thermosensitive recording layer depending on the temperature thereof will now be explained by referring to FIG. 1.

Figure 1:
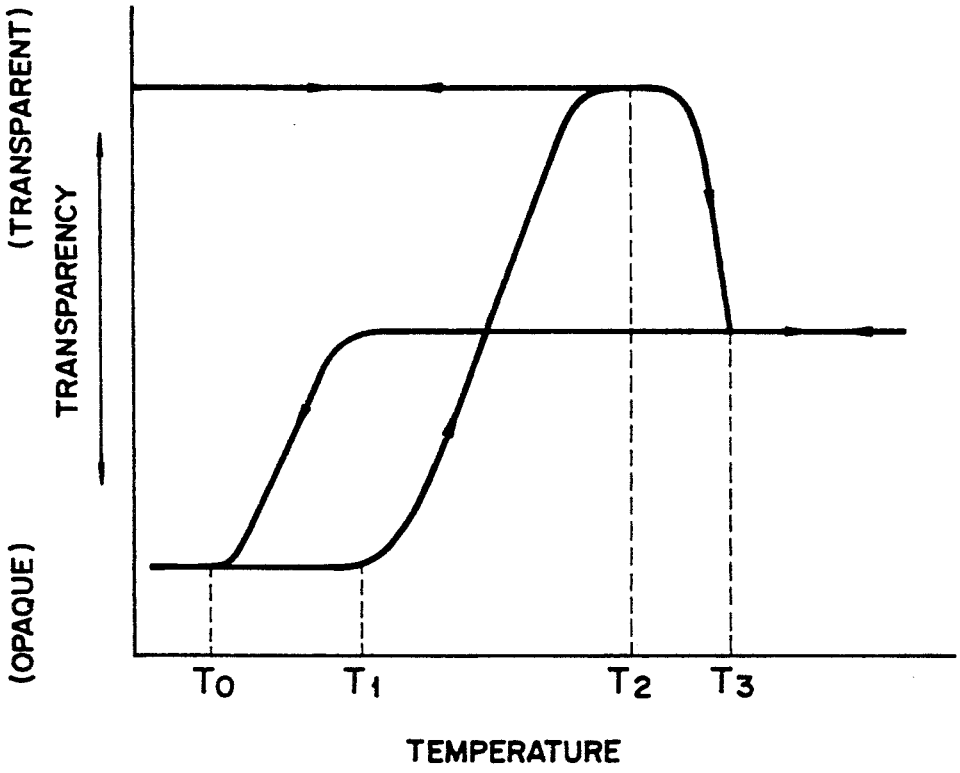
FIG. 1 is a graph in explanation of the principle of formation and erasure of images in a reversible thermosensitive recording material of the present invention.

In FIG. 1, it is supposed that the reversible thermosensitive recording material comprising a matrix resin and an organic low-molecular-weight material dispersed in the matrix resin is initially in a milky white opaque state at room temperature $T_0$ or below. When the recording material is heated to temperature $T_2$, the recording material becomes transparent. Thus, the recording material reaches a maximum transparent state at temperature $T_2$. Even if the recording material which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording material in the maximum transparent state is further heated to temperature $T_3$ or more, it assumes a medium state which is between the maximum transparent state and the maximum milky white opaque state. When the recording material in the medium state at temperature $T_3$ is cooled to room temperature $T_0$ or below, the recording material returns to the original maximum opaque state, without passing through any transparent state. It is considered that this is because the organic low-molecular-weight material is melted when heated to temperature $T_3$ or above, and the polycrystals of the organic low-molecular-weight material grow and separate out when it is cooled. If the recording material in the milky white opaque state is heated to any temperature between temperature $T_1$ and temperature $T_2$, and then cooled to a temperature below the room temperature $T_0$, the recording material assumes an intermediate state between the transparent state and the milky white opaque state.

When the recording material in the transparent state at room temperature $T_0$ is again heated to temperature $T_3$ or above, and then cooled to room temperature $T_0$, the recording material returns to the milky white opaque state. Thus, the reversible thermosensitive recording material according to the present invention can assume a milky white maximum opaque state, a maximum transparent state and an intermediate state between the aforementioned two states at room temperature.

Therefore, a milky white opaque image can be obtained on a transparent background, or a transparent image can also be obtained on a milky white opaque background by selectively applying the thermal energy to the reversible thermosensitive recording material according to the present invention. Further, such image formation and erasure can be repeated many times.

When a colored sheet is placed behind the reversible thermosensitive recording layer of the recording material, the colored image can be obtained on the white opaque background or the white opaque image can be obtained on the colored background.

In the case where the reversible thermosensitive recording material of the present invention is projected using an OHP (Over Head Projector), a milky white opaque portion in the recording material appears dark and a transparent portion in the recording material, through which the light passes becomes a bright portion on the screen.

It is preferable that the thickness of the reversible thermosensitive layer be in the range of 1 to 30 μm, more preferably in the range of 2 to 20 μm. When the thickness of the reversible thermosensitive layer is within the above range, the portions in the recording layer to which the heat energy is applied can uniformly assume a transparent state because the heat is uniformly distributed, and the whiteness degree of the white opaque portion in the recording layer is not lowered so as to maintain the high image contrast. When the amount of a fatty acid in the thermosensitive recording layer is properly increased, the whiteness degree can also be increased.

To record the image on the reversible thermosensitive recording material of the present invention and erase it therefrom, two thermal heads, one for the image formation and the other for the image erasure may, be used. Alternatively, a single thermal head is available if the conditions for applying the heat energy to the recording material can be changed depending on the recording operation and the erasing operation.

In the case where two thermal heads are used, a device for applying the heat energy to the recording material is expensive, however, the image formation and erasure can easily be performed by once causing the recording material to pass through the two thermal heads from which the different heat energy is separately applied to the recording material corresponding to the image formation and image erasure. On the other hand, in the case where a single thermal head is used for both image formation and erasure, the cost of the above-mentioned device is low, but the operation becomes complicated. More specifically, it is necessary to delicately change the heat application conditions of the single thermal head corresponding to a portion where an image is to be recorded or erased while the recording material is caused to pass through the single thermal head at one operation. Or the images are erased by applying the thermal energy for image erasure to the recording material while the recording material is first caused to pass through the single thermal head. Then, when the recording material is caused to reversibly pass through the single thermal head, the images are recorded by the application of the thermal energy for image formation to the recording material.

To form the reversible thermosensitive recording layer for use in the present invention in the form of a film or a sheet on the support, the following methods are available:

(1) A matrix resin and a low-molecular-weight organic material are dissolved in a solvent to prepare a coating liquid. The thus obtained coating liquid is coated on a support, and the solvent of the coating liquid is evaporated to obtain a reversible thermosensitive recording layer in the form of a film or a sheet.

(2) A matrix resin is dissolved in a solvent in which only the matrix resin can be dissolved, to prepare a solution. An organic low-molecular-weight material is ground and dispersed in the above solution, using various types of methods, to prepare a coating dispersion. The thus obtained coating dispersion is coated on the support, and the solvent of the coating dispersion is evaporated to obtain a reversible thermosensitive recording layer in the form of a film or a sheet.

(3) A matrix resin and a low-molecular-weight organic material are melted under application of heat without using any solvent and mixed. The thus obtained mixture is cooled to obtain a reversible thermosensitive recording layer in the form of a film of a sheet.

The solvent used for the formation of the thermosensitive recording layer can be selected depending on the kind of the matrix resin and the type of the organic low-molecular-weight material to be employed. For example, the solvents such as tetrahydrofuran, methyl ethyl ketone, methyl isobutyl ketone, chloroform, carbon tetrachloride, ethanol, toluene and benzene can be employed. When not only the matrix resin dispersion, but also the solution is used, the organic low-molecular-weight material in the form of finely-divided particles can be dispersed in the matrix resin in the thermosensitive recording layer.

It is preferable that resins for use in the matrix resin of the reversible thermosensitive layer of the reversible thermosensitive recording material of the present invention have excellent film-forming properties, high transparency and high mechanical stability. Examples of such resins include polyvinyl chloride resin; vinyl chloride copolymers such as vinyl chloride - vinyl acetate copolymer, vinyl chloride - vinyl acetate - vinyl alcohol copolymer, vinyl chloride - vinyl acetate - maleic acid copolymer and vinyl chloride - vinyl acrylate copolymer; vinylidene chloride copolymers such as polyvinylidene chloride, vinylidene chloride - vinyl chloride copolymer, vinylidene chloride - acrylonitrile copolymer; polyester; polyamide; polyacrylate, polymethacrylate or acrylate - methacrylate copolymer; and silicone resin. These resins can be used alone or in combination.

The organic low-molecular-weight material for use in the reversible thermosensitive recording layer may be appropriately selected from the materials which are changeable from the polycrystalline state to the single crystalline state in accordance with each of the desired temperatures ranging from $T_1$ to $T_3$ as shown in FIG. 1. It is preferable that the organic low-molecular-weight material for use in the present invention have a melting point ranging from 30° to 200° C., more preferably from about 50 to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids; and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the number of carbon atoms of the above-mentioned low-molecular-weight material be in the range of 10 to 60, more preferably in the range of 10 to 38, further preferably in the range of 10 to 30. Part of the alcohol groups in the esters may be saturated or unsaturated, and further may be substituted by halogen. In any case, it is preferable that the organic low-molecular-weight material have at least one atom selected from the group consisting of oxygen, nitrogen, sulfur and halogen in its molecule. More specifically, it is preferable the organic low-molecular-weight materials comprise, for instance, —OH, —COOH, —CONH, —COOR, —NH, —$NH_2$, —S—, —S—S—, —O— and a halogen atom.

Specific example of the above-mentioned organic low-molecular-weight materials include higher fatty acids such as lauric acid, dodecanoic acid, myristic acid, pentadecanoic acid, palmitic acid, stearic acid, behenic acid, nonadecanoic acid, arachic acid and oleic acid; esters of higher fatty acids such as methyl stearate, tetradecyl stearate, octadecyl stearate, octadecyl laurate, tetradecyl palmitate and dodecyl behenate; and the following ethers or thioethers:

$C_{16}H_{33}$—O—$C_{16}H_{33}$, $C_{16}H_{33}$—S—$C_{16}H_{33}$, $C_{18}H_{37}$—S—$C_{18}H_{37}$, $C_{12}H_{25}$—S—$C_{12}H_{25}$, $C_{19}H_{39}$—S—$C_{19}H_{39}$, $C_{12}H_{25}$—S—S—$C_{12}H_{25}$,

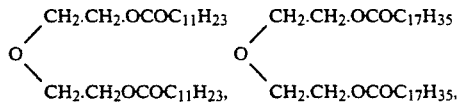

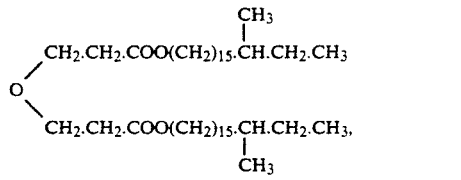

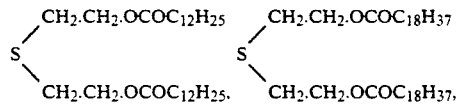

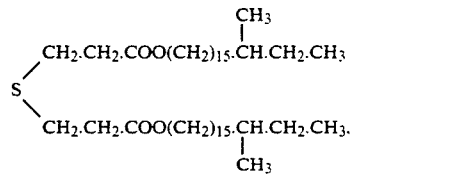

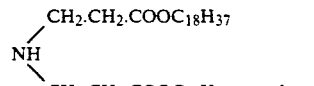

and

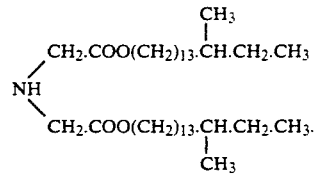

Of these, higher fatty acids having 16 or more carbon atoms more preferably having 16 to 24 carbon atoms, such as palmitic acid, pentadecanoic acid, nonadecanoic acid, arachic acid, stearic acid, behenic acid and lignoceric acid are preferred in the present invention.

It is preferable that the ratio by weight of the organic low-molecular-weight material to the matrix resin be in the range of about (2:1) to (1:16), more preferably in the range of (1:2) to (1:6) in the reversible thermosensitive recording layer. When the ratio of the low-molecular-weight material to the matrix resin is within the above range, the matrix resin can form a film in which the organic low-molecular-weight material is uniformly dispersed in the form of finely-divided particles, and the obtained recording layer can readily reach the maximum white opaque state.

In the reversible thermosensitive recording layer for use in the present invention, additives such as a surface-active agent and a high-boiling point solvent can be employed to facilitate the formation of a transparent image.

Examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol, di-2-ethyl butyrate, methyl acetylricinoleate, butyl acetylricinoleate, butylphthalyl butyl glycolate and tributyl acetylcitrate.

Examples of the surface-active agent are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid. amides of higher fatty acid, fat and oil and polypropylene glycol; acetylene glycol; sodium, calcium, barium and magnesium salts of higher alkyl benzenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; long-chain alkyl methacrylate - amine-containing monomer copolymer; styrene - maleic anhydride copolymer; and olefin - maleic anhydride copolymer.

In the present invention, when the image formed on the reversible thermosensitive recording material is observed as a reflection type image, a light reflection layer may be formed behind the recording layer to improve the contrast of the image even if the thickness of the recording layer is made thin. Specifically, the light reflection layer can be prepared by deposition of aluminum, nickel and tin on the support as disclosed in Japanese Laid-Open Patent Application 64-14079.

The reversible thermosensitive recording layer of the recording material according to the present invention has a scratching intensity of 10 g or more and a coefficient of friction of 0.10 or less on the surface thereof with which a recording means such as a thermal head comes into contact, so that the recording material is resistant to the heat and pressure applied by such recording means such as a thermal head and heat rollers and the surface of the recording material is hardly scratched by the thermal head and heat rollers. Furthermore, the dust formed from the surface of the recording material does not adhere to the thermal head even if the formation and erasure of images are repeated for an extend period of time.

The scratching intensity of the reversible thermosensitive recording layer of the recording material according to the present invention is measured by use of a commercially available surface property tester (Trademark "Type: Heidon-14S" made by Shinto Scientific Co., Ltd.).

The value of the scratching intensity is obtained by the weight of a load placed on a steel wool pressure-application member, using the above surface property tester.

More specifically, the temperature of a measuring stage of the surface property tester is adjusted to 100° C. A test sample of the reversible thermosensitive recording material of the present invention is fixed on the measuring stage. A commercially available steel wool piece (Roughness number #0) with a radius of 1.3 cm (made by Nippon Steal Wool Co., Ltd.) is placed on the test sample, under application of a pressure by a load with a predetermined weight. The measuring stage is then reciprocated two times in a horizontal direction. Then the surface properties of the recording layer are evaluated. In this measurement, the reciprocating speed of the measuring stage is 150 mm/min.

In this measurement, "scratches" in the recording layer are such scratches that can be identified when visually inspected from an angle of 45° with respect to the surface of the recording layer in the above reciprocating direction.

The scratching intensity of the test sample is determined by a weight of a load placed on the steel wool piece at which the "scratches" begin to appear as the weight of the load is increased. For instance, if the scratches begin to appear when the weight of the load is increased to 50 g, the scratching intensity of the test sample is evaluated to be "50 g or more".

Furthermore, the coefficient of friction in the present invention refers to the coefficient of dynamic friction, which is measured as follows by use of the commercially available surface property tester (Trademark "Type: Heidon-14S" made by Shinto Scientific Co., Ltd.):

The temperature of the measuring stage of the surface property tester is adjusted to 100° C. A test sample of the reversible thermosensitive recording material of the present invention is fixed on the measuring stage. A pressure application ball made of $Al_2O_3$ with a diameter of 5 mm with a load of 200 g is placed in contact with the test sample, and the measuring stage is then caused to slide in a horizontal direction at a speed of 150 mm/min, so that the force which works on the pressure application ball in the horizontal direction is measured and the value of the force is divided by the weight of the load. The thus obtained value is defined as the coefficient of friction in the present invention.

The protective layer for use in the reversible thermosensitive recording material according to the present invention comprises as the main component a heat resistant resin. For improvement of the sliding contact operation of a thermal head on the recording material, the protective layer may also contain a lubricant additive.

It is preferable that the heat resistant resin comprises an electron radiation curing resin component having a polyester skeleton with a branched molecular structure having 5 or more functional groups, and an electron radiation curing silicone-modified resin component.

The protective layer may also be composed of (a) a first protective layer which comprises as the main component a heat resistant resin, which is provided on the thermosensitive layer, and (b) a second protective layer comprising as the main components a heat resistant resin and a lubricant additive, which is overlaid on the first protective layer.

In the case where the protective layer is composed of a first protective layer and a second protective layer in the overlaid structure as mentioned above, it is also preferable that the first protective layer comprise a ultraviolet curing or electron radiation curing resin, and the second protective layer comprises a silicone- or fluorine-containing resin as will be explained in more detail. By providing any of these protective layers on the reversible thermosensitive layer, the reversible thermosensitive recording layer can be made free from the problems of (i) the sticking between the recording material and a thermal head which occurs by the repeated application of heat and pressure to an identical portion of the recording material in the course of the recording operation, and (ii) the surface of the recording material being scratched by the thermal head. In particular, the sticking is prevented by the use of a lubricant additive or a resin having lubricating properties, and the scratching problem is prevented by use of a heat resistant and hard resin.

Figure 2:
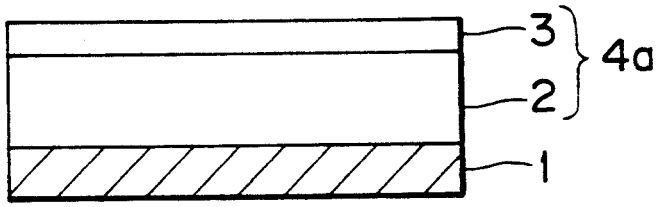
FIG. 2 is a schematic cross-sectional view of an example of a reversible thermosensitive recording material of the present invention.

FIG. 2 shows an example of a reversible thermosensitive recording material according to the present invention. In the figure, reference numeral 1 indicates a support; reference numeral 2, a reversible thermosensitive layer; reference numeral 3, a protective layer; and reference 4*a*, a reversible thermosensitive recording layer. In this reversible thermosensitive recording material, it is preferable that the protective layer 3 have a thickness of 0.1 to 30 μm.

Figure 3:
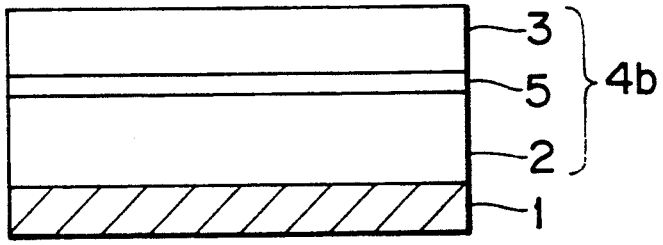
FIG. 3 is a schematic cross-sectional view of another example of a reversible thermosensitive recording material of the present invention.

FIG. 3 shows another example of a reversible thermosensitive recording material according to the present invention. In the figure, reference numeral 1 indicates a support; reference numeral 2, a reversible thermosensitive layer; reference numeral 3, a protective layer; and reference 5, an intermediate layer; and reference numeral 4*b*, a reversible thermosensitive recording layer.

The protective layer 3 in the above reversible thermosensitive recording materials may comprises a first protective layer overlaid on the reversible thermosensitive layer 2 or on the intermediate layer 5, and a second protective layer overlaid on the first protective layer.

The protective layer 3 comprises as the main component a heat resistant and hard resin. Examples of such a heat resistant resin include thermosetting resins, ultraviolet-curing resins, and electron radiation curing resins, such as urethane resin, epoxy resin, organosiloxane resin, polyfunctional acrylate resin, melamine resin; thermoplastic resins having high softening points such as fluorine plastics, silicone resin, polybenzoimidazole, and polycarbonate. Of these resins, the ultraviolet-curing resins and electron radiation curing resins disclosed in Japanese Laid-Open Patent Application 2-566 are preferable for use in the protective layer in the present invention.

When the protective layer 3 is composed of a first protective layer and a second protective layer overlaid on the first protective layer, the first protective layer can be composed of any of the above resins, but it is preferable that the second protective layer be composed of a resin which has particularly lubricating properties. Examples of such a resin having lubricating properties include silcone-containing resins such as silicone resin, silicone rubber, polysiloxane graft polymers, silicone-modified resins, for example, silicone-modified urethane resin, and silicone-modified acrylic resin; and fluorine-containing resins such as fluorine plastics, fluorine rubber, graft polymers containing fluorine segments, and fluorine-modified resins.

Alternatively the second protective layer may be composed of any of the above-mentioned heat resistant resins and a lubricating additive such as silicone oil, surface active agents, organic salts, waxes, lubricating fillers such as silicone powder, calcium carbonate, barium sulfate, molybdenum dioxide, and cross-linked urea resin.

It is preferable that the first protective layer have a thickness of 0.1–20.0 μm and that the second protective layer have a thickness of 0.001–2.0 μm, more preferably 0.1–1.5 μm.

Examples of the silicone oil for use in the protective layer are dimethyl polysiloxane, methylphenyl polysiloxane, methyl hydrogenpolysiloxane, alkyl-modified polysiloxane, amino-modified polysiloxane, carboxyl-modified polysiloxane and alcohol-modified polysiloxane.

Examples of the surface active agent are commercially available salts of carboxylic acids, sulfuric acid esters of higher alcohols, salts of sulfonic acids, phosphoric acid esters and salts of higher alcohols.

Specific examples of these compounds include sodium laurate, sodium stearate, sodium oleate, lauryl alcohol sodium sulfuric ester, myristyl alcohol sodium sulfuric ester, cetyl alcohol sodium sulfuric ester, stearyl alcohol sodium sulfuric ester, oleyl alcohol sodium sulfuric ester, sodium sulfuric esters of higher alcohol ethylene oxide adducts, sodium octyl sulfonate, sodium decyl sulfonate, sodium dodecyl sulfonate, sodium octyl benzene sulfonate, sodium dodecyl benzene sulfonate, sodium nonyl naphthalene sulfonate, sodium dodecyl naphthalene sulfonate, potassium dodecyl naphthalene sulfonate, sodium N-oleoyl-N-methyl taurine, tetraethoxy lauryl alcohol ester, sodium monostearyl phosphate, and sodium distearyl phosphate.

Examples of the above-mentioned organic salt include metallic soaps such as zinc stearate, aluminum stearate, calcium stearate, magnesium stearate; salts such as hexyl ammonium chloride, sodium sulfosalicylate, sodium succinate, potassium succinate, potassium benzoate and potassium adipate.

Examples of the wax are natural waxes such as candelilla wax, carnauba wax, rice wax, bees wax, lanolin wax, montan wax, paraffin wax, microcrystalline wax; synthetic waxes such as polyethylene wax, hardened caster oil and derivatives thereof, and fatty acid amides.

Further, it is preferable that such lubricants be contained in the protective layer in such an amount of 0.001 to 15.0 wt. % of the total weight of the protective layer to maintain the mechanical strength of the protective layer and to impart the lubricating properties to the protective layer.

Examples of the lubricant fillers are inorganic and organic finely-divided particles of calcium carbonate, kaolin, silica, aluminum hydroxide, alumina, aluminum silicate, magnesium hydroxide, magnesium carbonate, magnesium oxide, titanium oxide, zinc oxide, barium sulfate, urea-formaldehyde resin and styrene resin. It is preferable that the particle diameter of the above-mentioned finely-divided particles be in the range of about 0.01 to 20 μm. Furthermore, it is preferable that the shape of the filler particles be spherical and that the filler have lubricating properties such as those of silicone resin and fluoroplastics. It is also preferable that the ratio by weight of the filler in the protective layer be 0.1 to 70.0 wt. %. When the ratio by weight of the filler in the protective layer is within the above range, the filler does not easily separate from the resin and the lubricating effect can be maintained.

The main components of the protective layer for use in the present invention are preferably (i) an electron radiation curing resin having a polyester skeleton and a branched molecular structure with 5 or more functional groups, which is hereinafter referred as to an electron radiation curing acryl-modified polyurethane resin, and (ii) a silicone-modified electron radiation curing resin.

The above-mentioned electron radiation curing acryl modified polyurethane resin can be prepared in accordance with the following method:

1.4-butanediol and adipic acid, or propylene glycol and adipic acid are allowed to react to prepare a reaction product, which corresponds to a polyester skeleton moiety. To a mixture of a polyester diol of the reaction product and a polyether triol of the reaction product, diisocyanate and a compound having an acrylic double bond are added, followed by allowing the mixture to react, whereby the electron radiation curing acryl-modified polyurethane resin can be obtained.

Instead of the mixture of the polyester diol and the polyether triol, for example, a mixture of polyether diol and polyether triol, a mixture of polyester diol and polyester triol, and a mixture of polyether diol and polyester triol can also be employed.

Examples of diisocyanate include 2,4-tolylene diisocyanate, 2,6-tolylene diisocyanate, 1,6-hexamethylene diisocyanate, xylylene diisocyanate, isophorone diisocyanate and methylene-bis(4-phenyl isocyanate).

Examples of the compound having an acrylic double bond include 2-hydroxyethyl(meth)acrylate, 2-hydroxypropyl(meth)acrylate, and 3-hydroxypropyl(meth)acrylate.

The polyester diol is commercially available, for example, under the trademark "Adeka New Ace Y4–30" made by Asahi Denka Kogyo K. K. and the polyether triol is also commercially available, for example, under the trademark "Sannix TP-400" and under the trademark "Sannix GP-3000" made by Sanyo Chemical Industries, Ltd.

It is preferable that the molecular weight of the polyester moiety of the electron radiation curing acryl modified polyurethane resin be in the range of 2,000 to 4,000 to impart the necessary flexibility and toughness for the protective layer. For the same reason as mentioned above, it is preferable that the molecular weight of the electron radiation curing acryl modified polyurethane resin be in the range of 20,000 to 50,000. because of the same reason mentioned above. Furthermore, the number of the functional groups of the electron radiation curing acryl-modified polyurethane resin is preferably 5 or more, more preferably 7 to 8 to improve the hardening acceleration effect and the hardness thereof.

The silicone modified electron radiation curing resin has the following general formula:

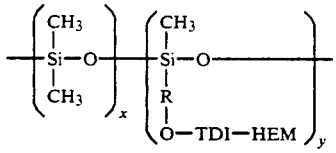

wherein R is $\text{-}(C_2)_n\text{-}$, where n=0 to 3, TDI is 2,4-tolylene diisocyanate and HEM is hydroxyethyl acrylate, x=50 to 100 and y=3 to 6.

The above-mentioned silicone-modified electron radiation curing resin can form a uniformly thin film since the resin is excellent in film-forming properties. Moreover, the silicone-modified electron radiation curing resin is excellent in lubricating performance because the resin contains silicone functional groups.

The ratio by weight of the electron radiation curing silicone-resin to the electron radiation curing acryl-modified polyurethane resin is preferably up to 30 parts by weight to 100 parts by weight, more preferably 5–20 parts by weight to 100 parts by weight.

It is preferable that a polyfunctional electron radiation curing monomer be employed in combination with the above-mentioned resins when forming the protective layer in the present invention to accelerate the hardening of the protective layer and impart a heat-resistant effect to the protective layer. The use of such a monomer is effective to form a complicated crosslinked structure with high density.

Specific examples of such a monomer are trimethylpropane triacrylate, tetramethylol methane tetraacrylate, pentaerythritol triacrylate, and dipentaerythritol hexa triacrylate.

It is preferable that the ratio of such a monomer to the electron radiation curing acryl-modified polyurethane resin be up to 50 parts by weight to 100 parts by weight, more preferably 20–50 parts by weight to 100 parts by weight to form the crosslinked structure with high density and to impart lubricating properties to the protective layer.

A phosphazene resin can also be employed in the protective layer. The phosphazene resin includes repeating units of the following phosphazo group:

$$\text{-}(P{=}N)\text{-}$$

A specific example of such a phosphazene resin is represented by the following formula, but is not limited to this:

$$\text{-}(NP(A)_a(B)_b)\text{-}_n$$

wherein, a>0, b≧0, a and b being real numbers which satisfies a +b=2; A is a polymerizable curable group, such as a methacryloyl hydroxyethyl group; and B is

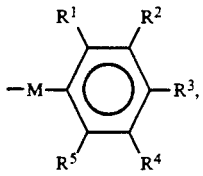

wherein, $R^1$ to $R^5$ represent hydrogen, chlorine, bromine, or a halogenated alkyl group having 1 to 4 carbon atoms, and M represents oxygen, sulfur or an imino group.

A phosphazene resin, for instance, in which A is a methacryloyl hydroxyethyl group and b=0, in the above formula, can be prepared by the ring opening polymerization of a compound represented by the following formula:

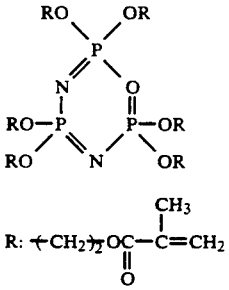

In the resins having polymerizable curable groups, such as a phosphazene resin, the mechanical strength, hardness, and the heat resistance thereof can be improved by curing the resin with application of ultraviolet rays, electron radiation and heat thereto.

In the present invention, if it is necessary to print some additional information on the reversible thermosensitive recording material according to the present invention, it is preferable to make such printing between the thermosensitive layer and the protective layer, or between the first protective layer and the second protective layer for secure printing and preventing the sticking problem.

The reversible thermosensitive recording layer can be provided on a magnetic layer formed on a support or on the back side of the support opposite to the magnetic layer to form a magnetic reversible thermosensitive recording layer, which may be in the form of a card.

Other features of this invention will become apparent in the course of the following description of exemplary embodiments which are given for illustration of the invention and are not intended to be limiting thereof.

EXAMPLE 1

Formation of Reversible Thermosensitive Recording Layer

The following components were mixed to prepare a coating liquid:

| | Parts by Weight |
|---|---|
| Behenic acid | 6 |
| Eicosanedioic acid | 4 |
| Diallyl phthalate | 2 |
| Vinyl chloride-vinyl acetate copolymer (Trademark "VYHH" made by Union Carbide Japan K.K.) | 35 |
| Tetrahydrofuran | 150 |
| Toluene | 50 |

The above prepared liquid was coated on a transparent polyester film having a thickness of 100 μm, serving as a support, by a wire bar and dried under application of heat thereto, so that a reversible thermosensitive recording layer with a thickness of 15 μm was formed on the support.

Formation of First Protective Layer

The following components were mixed to prepare a coating liquid:

| | Parts by Weight |
|---|---|
| 75% butyl acetate solution of urethane-acrylate type ultraviolet-curing resin (Trademark "Unidic C7-157" made by Dainippon Ink & Chemicals, Incorporated) | 10 |
| Toluene | 10 |

The above prepared coating liquid was coated on the above formed reversible thermosensitive recording layer by a wire bar, dried under application of heat thereto and cured using an ultraviolet lamp of 80 W/cm, so that a first protective layer with a thickness of about 3 μm was formed on the reversible thermosensitive recording layer.

Formation of Second Protective Layer

The following components were mixed to prepare a coating liquid:

| | Parts by Weight |
|---|---|
| Silicone-modified polyurethane resin (Trademark "Daiallomer SP2105" made by Dainichiseika Color and Chemicals Mfg. Co., Ltd.) | 100 |
| Crosslinking agent (Trademark "Crossnate D70" made by Dainichiseika Color and Chemicals Mfg. Co., Ltd.) | 50 |
| Methyl ethyl ketone | 1500 |
| Toluene | 150 |

The above prepared coating liquid was coated on the above formed first protective layer by a wire bar, dried under application of heat thereto, so that a second protective layer with a thickness of about 0.5 μm was formed on the first protective layer.

The thus prepared recording material was subjected to aging in a drying machine at 50° C. for 10 days, so that a reversible thermosensitive recording material according to the present invention was obtained.

EXAMPLE 2

The procedure for preparation of the reversible thermosensitive recording material in Example 1 was repeated except that 5 parts by weight of a commercially available amino-modified silicone oil "KF867" (Trademark) made by Shin-Etsu Chemical Co., Ltd., represented by the following formula, was added to the formulation of the coating liquid for the second protective layer used in Example 1, whereby a reversible thermosensitive recording material according to the present invention was formed.

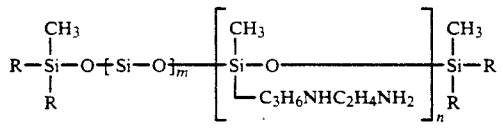

wherein R represents $CH_3$ or $OCH_3$.

EXAMPLE 3

The procedure for preparation of the reversible thermosensitive recording material in Example 1 was repeated except that the formulation of the second protective layer used in Example 1 was changed as follows:

| | Parts by Weight |
|---|---|
| Polymethyl methacrylate resin | 100 |
| Acrylic silicone resin (Trademark "UA-01" made by Sanyo Chemical Industries, Ltd.) | 100 |
| Tin-type catalyst (Trademark "Cat 65MC") | 5 |
| Methyl ethyl ketone | 1500 |
| Toluene | 150 |

Thus, a reversible thermosensitive recording material according to the present invention was obtained.

EXAMPLE 4

Formation of Reversible Thermosensitive Recording Layer

The following components were mixed to prepare a coating liquid:

| | Parts by Weight |
|---|---|
| Behenic acid | 6 |
| Eicosanedioic acid | 4 |
| Diallyl phthalate | 2 |
| Vinyl chloride-vinyl acetate copolymer (Trademark "VYHH" made by Union Carbide Japan K.K.) | 35 |
| Tetrahydrofuran | 150 |
| Toluene | 50 |

The above prepared coating liquid was coated on a transparent polyester film having a thickness of 100 μm, serving as a support, by a wire bar and dried under application of heat thereto, so that a reversible thermosensitive recording layer with a thickness of 15 μm was formed on the support.

Formation of Intermediate Layer

The following components were mixed to prepare a coating liquid:

| | Parts by Weight |
|---|---|
| Polyamide resin (Trademark "CM 8000" made by Toray Industries, Inc.) | 10 |
| Ethyl alcohol | 90 |

The above prepared coating liquid was coated on the above formed reversible thermosensitive recording layer by a wire bar, and dried under application of heat thereto, so that an intermediate layer with a thickness of about 0.5 μm was formed on the reversible thermosensitive recording layer.

Formation of Protective Layer

A mixture of the following components was uniformly dispersed to prepare a coating dispersion:

| | Parts by Weight |
|---|---|
| 75% butyl acetate solution of urethane-acrylate type ultraviolet-curing resin (Trademark "Unidic C7-157" made by Dainippon Ink & Chemicals, Incorporated) | 10 |
| Methylphenyl silicone oil (Trademark "Shin-Etsu Silicone KF50" made by Shin-Etsu Chemical Co., Ltd.) (1% toluene/methyl ethyl ketone solution, mixing ratio: 1:1) | 0.08 |
| Mixed solvent of toluene and methyl ethyl ketone (mixing ratio: 1:1) | 10 |

The above prepared coating dispersion was coated on the above formed intermediate layer by a wire bar, dried under application of heat thereto and hardened by using an ultraviolet lamp of 80 W/cm, so that a protective layer having a thickness of about 3.0 μm was formed on the intermediate layer.

Thus, a reversible thermosensitive recording material according to the present invention was obtained.

EXAMPLE 5

The procedure for preparation of the reversible thermosensitive recording material in Example 4 was repeated except that the methylphenyl silicone oil "Shin-Etsu Silicone KF50" (Trademark) used in the coating liquid for the protective layer in Example 4 was replaced by a commercially available alcohol-modified silicone oil, "SF8428" (Trademark) made by Toray Silicone Co., Ltd., whereby a reversible thermosensitive recording material according to the present invention was obtained.

EXAMPLE 6

The procedure for preparation of the reversible thermosensitive recording material in Example 4 was repeated except that the formulation of the coating liquid for the protective layer used in Example 4 was changed as follows:

| | Parts by Weight |
|---|---|
| 75% butyl acetate solution of urethane-acrylate type ultraviolet-curing resin (Trademark "Unidic C7-157" made by Dainippon Ink & Chemicals, Incorporated) | 10 |
| Zinc stearate (melting point (mp): 127° C.) | 0.8 |
| Toluene | 10 |

Thus, a reversible thermosensitive recording material according to the present invention was obtained.

EXAMPLE 7

The procedure for preparation of the reversible thermosensitive recording material in Example 6 was repeated except that zinc stearate used in the coating liquid for the protective layer in Example 6 was replaced by magnesium stearate with a melting point of 132° C, whereby a reversible thermosensitive recording material according to the present invention was obtained.

EXAMPLE 8

Formation of Reversible Thermosensitive Recording Layer

The following components were mixed to prepare a coating liquid:

| | Parts by Weight |
|---|---|
| Behenic acid | 6 |
| Eicosanedioic acid | 4 |
| Diallyl phthalate | 2 |
| Vinyl chloride-vinyl acetate copolymer (Trademark "VYHH" made by Union Carbide Japan K.K.) | 35 |
| Tetrahydrofuran | 150 |
| Toluene | 50 |

The above prepared coating liquid was coated on a transparent polyester film having a thickness of 100 μm, serving as a support, by a wire bar and dried under application of heat thereto, so that a reversible thermosensitive recording layer with a thickness of about 15 μm was formed on the support.

Formation of Intermediate Layer

The following components were mixed to prepare a coating liquid:

| | Parts by Weight |
|---|---|
| Polyamide resin (Trademark "CM8000" made by Toray Industries, Inc.) | 10 |
| Ethyl alcohol | 90 |

The above prepared coating liquid was coated on the above formed reversible thermosensitive recording layer by a wire bar, and dried under application of heat thereto, so that an intermediate layer with a thickness of about 1.0 μm was formed on the reversible thermosensitive recording layer.

Formation of Protective Layer

A mixture of the following components was uniformly dispersed to prepare a coating dispersion:

| | Parts by Weight |
|---|---|
| 75% butyl acetate solution of urethane-acrylate type ultraviolet-curing resin (Trademark "Unidic 17-824-9" made by Dainippon Ink & Chemicals, Incorporated) | 10 |
| Silicone powder (Trademark "XC99-301" made by Toshiba Silicone Co., Ltd.) (average particle diameter: 4 μm) | 0.08 |
| Mixed solvent of toluene and methyl ethyl keton (mixing ratio: 1:1) | 10 |

The above prepared coating dispersion was coated on the above formed intermediate layer by a wire bar, dried under application of heat thereto and hardened by using an ultraviolet lamp of 80 W/cm, so that a protective layer having a thickness of about 5.0 μm was formed on the intermediate layer.

Thus, a reversible thermosensitive recording material according to the present invention was obtained.

EXAMPLE 9

The procedure for preparation of the reversible thermosensitive recording material in Example 8 was repeated except that the formulation of the protective layer used in Example 8 was changed as follows:

| | Parts by Weight |
|---|---|
| Phosphazene resin (Trademark "U-2000" made by Idemitsu Petrochemical Co., Ltd.) | 10 |
| Polystyrene beads | 1 |
| Toluene | 10 |

Thus, a reversible thermosensitive recording material according to the present invention was obtained.

EXAMPLE 10

Formation of Reversible Thermosensitive Recording Layer

The following components were mixed to prepare a coating liquid:

| | Parts by Weight |
|---|---|
| Behenic acid | 6 |
| Eicosanedioic acid | 4 |
| Diallyl phthalate | 2 |
| Vinyl chloride-vinyl acetate copolymer (Trademark "VYHH" made by Union Carbide Japan K.K.) | 35 |
| Tetrahydrofuran | 150 |
| Toluene | 50 |

The above prepared coating liquid was coated on a transparent polyester film having a thickness of 100 μm, serving as a support, by a wire bar and dried under application of heat thereto, so that a reversible thermosensitive recording layer with a thickness of about 15 μm was formed on the support.

Formation of Intermediate Layer

The following components were mixed to prepare a coating liquid:

| | Parts by Weight |
|---|---|
| Polyamide resin (Trademark "CM8000" made by Toray Industries, Inc.) | 10 |
| Ethyl alcohol | 90 |

The above prepared coating liquid was coated on the above formed reversible thermosensitive recording layer by a wire bar, and dried under application of heat thereto, so that an intermediate layer with a thickness of about 0.5 μm was formed on the reversible thermosensitive recording layer.

Formation of Protective Layer

A mixture of the following components was uniformly dispersed to prepare a coating dispersion:

| | Parts by Weight |
|---|---|
| Electron radiation curing acryl-modified polyurethane resin (a reaction product with a branched structure of polyester diol "Adeka New Ace Y4-30" (Trademark) made by Asahi Denka Kogyo K.K (having a polyester moiety with a molecular weight of about 3000), polyester triol "TP-400" (Trademark) made by Sanyo Chemical Industries, Ltd., 2,6-tolylene diisocyanate and hydroxy ethyl acrylate) (Number of functional groups: 10, Molecular weight: 30000) | 10 |
| Polyfunctional monomer (Trademark "M-8030" made by Toagosei Chemical Industry Co., Ltd.) | 3 |
| Silicone-modified urethane acrylate (Trademark "19-4842" made by Freeman | 2 |

-continued

| | Parts by Weight |
|---|---|
| Co., Ltd.) | |
| Mixed solvent of methyl ethyl ketone and toluene (mixing ratio: 1:1) | 50 |

The above prepared coating dispersion was coated on the above formed intermediate layer by a wire bar, and dried under application of heat thereto. Then, the coated surface was exposed to electron rays (1 mrad), so that a protective layer having a thickness of about 2.0 μm was formed on the intermediate layer.

Thus, a reversible thermosensitive recording material according to the present invention was obtained.

EXAMPLE 11

Formation of Reversible Thermosensitive Recording Layer

The following components were mixed to prepare a coating liquid:

| | Parts by Weight |
|---|---|
| Behenic acid | 6 |
| Eicosanedioic acid | 4 |
| Diallyl phthalate | 2 |
| Vinyl chloride-vinyl acetate copolymer (Trademark "VYHH" made by Union Carbide Japan K.K.) | 35 |
| Tetrahydrofuran | 150 |
| Toluene | 50 |

The above prepared coating liquid was coated on a transparent polyester film having a thickness of 100 μm, serving as a support, by a wire bar and dried under application of heat thereto, so that a reversible thermosensitive recording layer with a thickness of about 15 μm was formed on the support.

Formation of Intermediate Layer

The following components were mixed to prepare a coating liquid:

| | Parts by Weight |
|---|---|
| Polyamide resin (Trademark "CM8000" made by Toray Industries, Inc.) | 10 |
| Methanol | 90 |

The above prepared coating liquid was coated on the above formed reversible thermosensitive recording layer by a wire bar, and dried under application of heat thereto, so that an intermediate layer with a thickness of about 1.0 μm was formed on the reversible thermosensitive recording layer.

Formation of Protective Layer

A mixture of the following components was uniformly dispersed to prepare a coating dispersion:

| | Parts by Weight |
|---|---|
| Phosphazene resin (Trademark "U-2000" made by Idemitsu Petrochemical | 10 |

-continued

| | Parts by Weight |
|---|---|
| Co., Ltd.) | |
| Toluene | 10 |

The coating dispersion was coated on the above formed intermediate layer by a wire bar, dried under application of heat thereto and hardened by using an ultraviolet lamp of 80 W/cm, so that a protective layer having a thickness of about 3.0 μm was formed on the intermediate layer.

Thus, a reversible thermosensitive recording material according to the present invention was obtained.

COMPARATIVE EXAMPLE 1

Formation of Reversible Thermosensitive Recording Layer

The following components were mixed to prepare a coating liquid:

| | Parts by Weight |
|---|---|
| Behenic acid | 6 |
| Eicosanedioic acid | 4 |
| Diallyl phthalate | 2 |
| Vinyl chloride-vinyl acetate copolymer (Trademark "VYHH" made by Union Carbide Japan K.K.) | 35 |
| Tetrahydrofuran | 150 |
| Toluene | 50 |

The above prepared coating liquid was coated on a transparent polyester film having a thickness of 100 μm, serving as a support, by a wire bar and dried under application of heat thereto, so that a reversible thermosensitive recording layer with a thickness of about 15 μm was formed on the support.

Formation of Protective Layer

The following components were mixed to prepare a coating liquid:

| | Parts by Weight |
|---|---|
| 75% butyl acetate solution of urethane-acrylate type ultraviolet-curing resin (Trademark "Unidic C7-157" made by Dainippon Ink & Chemicals, Incorporated) | 10 |
| Toluene | 10 |

The above prepared coating liquid was coated on the above formed reversible thermosensitive recording layer by a wire bar, dried under application of heat thereto and hardened by using an ultraviolet lamp of 80 W/cm, so that a protective layer was formed on the reversible thermosensitive recording layer.

Thus, a comparative reversible thermosensitive recording material was obtained.

COMPARATIVE EXAMPLE 2

The procedure for preparation of the reversible thermosensitive recording material in Example 8 was repeated except that the formulation of the coating liquid for the protective layer used in Example 8 was changed as follows:

| | Parts by Weight |
|---|---|
| 75% butyl acetate solution of urethane-acrylate type ultraviolet-curing resin (Trademark "Unidic 17-824-9" made by Dainippon Ink & Chemicals, Incorporated) | 10 |
| Mixed solvent of toluene and methyl ethyl ketone (mixing ratio: 1:1) | 10 |

Thus, a comparative reversible thermosensitive recording material was obtained.

COMPARATIVE EXAMPLE 3

The procedure for preparation of the reversible thermosensitive recording material in Example 10 was repeated except that 2 parts by weight of the commercially available silicone-modified urethane acrylate employed in the coating liquid for the protective layer was not used, whereby a comparative reversible thermosensitive recording material was obtained.

COMPARATIVE EXAMPLE 4

The procedure for preparation of the reversible thermosensitive recording material in Example 10 was repeated except that 10 parts by weight of the commercially available electron radiation curing acryl-modified polyurethane resin employed in the coating liquid for the protective layer was not used, whereby a comparative reversible thermosensitive recording material was obtained.

COMPARATIVE EXAMPLE 5

The procedure for preparation of the reversible thermosensitive recording material in Example 11 was repeated except that the formulation of the coating liquid for the protective layer used in Example 11 was changed as follows:

| | Parts by Weight |
|---|---|
| Silicone resin (Trademark "SR2411" made by Dow Corning Toray Silicone Co., Ltd.) | 10 |
| Toluene | 10 |

Thus, a comparative reversible thermosensitive recording material was obtained.

Image formation and erasure was repeated 100 times in each of the above reversible thermosensitive recording materials according to the present invention obtained in Examples 1 to 11 and comparative reversible thermosensitive recording materials obtained in Comparative Examples 1 to 5, by using a commercially available print testing apparatus made by Yashiro Denki Co., Ltd. More specifically, solid images were formed on the recording material by using the print testing apparatus employing a thermal head made by Ricoh Company Ltd., with a recording density of 8 dots/mm, under the condition that the applied platen pressure was 1.0 kg, the applied pulse width was 1 ms and the applied electrical power was 25 V. After 100-times repetition of the image formation and erasure, the degree of scratches on the surface of the recording material, adhesion of dust to the thermal head, the partial non-image formation, the sticking problem and deterioration of obtained images were evaluated. The results are shown in Table 1.

The partial non-image formation caused by dust adhesion to the thermal head and scratches on the surfaces of the above-prepared reversible thermosensitive recording materials were visually inspected. Moreover, the deterioration of images on the above-prepared reversible thermosensitive recording materials was expressed by the difference between the density of a milky white opaque portion of the recording material after 1st image formation and that of the recording material after 100th image formation. The density of the white opaque portion in each reversible thermosensitive recording material was measured by Macbeth reflection-type densitometer RD-914.

Thereafter, the scratching intensity and the coefficient of friction of each reversible thermosensitive recording material were measured by a commercially available surface property tester. The results are shown in Table 2.

As can be seen from the results in Tables 1 and 2, proper hardness and lubricating properties of the protective layer can be obtained when the recording material is heated, since the reversible thermosensitive recording material according to the present invention comprises a reversible thermosensitive recording layer having a temperature-dependent transparency, and a protective layer, formed thereon, having a scratching intensity of 10 g or more and a coefficient of friction of 0.10 or less. Therefore, the surface of the reversible thermosensitive recording material can be protected from being scratched, adhesion of dust to the thermal head can be avoided and partial non-image formation can be prevented in the course of the repeated operations of image formation and erasure.

TABLE 1

| | 100-Times Repetition of Image Formation and Erasure | | | | |
|---|---|---|---|---|---|
| | Scratches on the Surface | Adhesion of Dust to Thermal Head | Partial Non-Image Formation | Sticking | Deterioration of Images |
| Ex. 1 | C | C | A | A | Δ 0.08 |
| Ex. 2 | A | A | A | A | Δ 0.06 |
| Ex. 3 | B | C | A | A | Δ 0.08 |
| Ex. 4 | B | C | A | A | Δ 0.10 |
| Ex. 5 | B | C | A | A | Δ 0.10 |
| Ex. 6 | C | C | A | A | Δ 0.12 |
| Ex. 7 | C | C | A | A | Δ 0.12 |
| Ex. 8 | C | B | A | A | Δ 0.10 |
| Ex. 9 | A | A | A | A | Δ 0.06 |
| Ex. 10 | A | A | A | A | Δ 0.06 |
| Ex. 11 | B | A | A | A | Δ 0.08 |
| Comp. Ex. 1 | E | E | E | D | Δ 0.25 |
| Comp. Ex. 2 | E | E | E | C | Δ 0.21 |
| Comp. Ex. 3 | E | D | D | D | Δ 0.30 |
| Comp. Ex. 4 | E | D | D | D | Δ 0.25 |
| Comp. Ex. 5 | E | D | D | D | Δ 0.25 |

A: None
B: Mild
C: Moderate
D: Medium
E: Excessive

TABLE 2

| | Scratching intensity | Coefficient of friction |
|---|---|---|
| Ex. 1 | 10 g or more | 0.04 |
| Ex. 2 | 10 g or more | 0.02 |
| Ex. 3 | 20 g or more | 0.04 |
| Ex. 4 | 100 g or more | 0.06 |
| Ex. 5 | 100 g or more | 0.07 |
| Ex. 6 | 50 g or more | 0.06 |
| Ex. 7 | 50 g or more | 0.07 |
| Ex. 8 | 50 g or more | 0.10 |
| Ex. 9 | 100 g or more | 0.03 |
| Ex. 10 | 100 g or more | 0.04 |
| Ex. 11 | 100 g or more | 0.04 |
| Comp. Ex. 1 | 100 g or more | 0.12 |
| Comp. Ex. 2 | 100 g or more | 0.15 |
| Comp. Ex. 3 | 50 g or more | 0.15 |
| Comp. Ex. 4 | 5 g or more | 0.04 |
| Comp. Ex. 5 | 5 g or more | 0.04 |

Thus, the reversible thermosensitive recording material according to the present invention is capable of yielding images with a uniform high quality even when image formation is repeated.

What is claimed is:

1. A reversible thermosensitive recording material comprising a support and a reversible thermosensitive recording layer formed thereon, said reversible thermosensitive recording layer comprising a reversible thermosensitive layer which comprises an organic low-molecular weight material and a resin matrix and a protective layer which comprises a heat resistant resin formed thereon and the surface of said reversible thermosensitive thermal layer having a scratching intensity of 10 g or more and a coefficient of friction of 0.10 or less.

2. The reversible thermosensitive recording material as claimed in claim 1, wherein said protective layer comprises a heat resistant resin and a lubricating additive.

3. The reversible thermosensitive recording material as claimed in claim 2, wherein said protective layer has a thickness of 0.1 to 30 μm.

4. The reversible thermosensitive recording material as claimed in claim 1, wherein said protective layer comprises a first protective layer comprising a heat resistant resin overlaid on said reversible thermosensitive layer, and a second protective layer comprising a heat resistant resin and a lubricating additive, which is overlaid on said first protective layer.

5. The reversible thermosensitive recording material as claimed in claim 4, wherein a printed portion is provided between said first protective layer and said second protective layer.

6. The reversible thermosensitive recording material as claimed in claim 4, wherein said first protective layer has a thickness of 0.1 to 20 μm, and said second protective layer has a thickness of 0.001 to 2.0 μm.

7. The reversible thermosensitive recording material as claimed in claim 1, wherein said heat resistant resin comprises an electron radiation curing resin component having a polyester skeleton with a branched molecular structure having 5 or more functional groups, and an electron radiation curing silicone-modified resin component.

8. The reversible thermosensitive recording material as claimed in claim 7, wherein said first protective layer has a thickness of 0.1 to 20 μm, and said second protective layer has a thickness of 0.001 to 2.0 μm.

9. The reversible thermosensitive recording material as claimed in claim 1, wherein said heat resistant resin is a phosphazene resin.

10. The reversible thermosensitive recording material as claimed in claim 1, wherein said protective layer comprises a first protective layer comprising a ultraviolet curing or electron radiation curing resin overlaid on said reversible thermosensitive layer, and a second protective layer comprising a silicone- or fluorine-containing resin, which is overlaid on said first protective layer.

11. The reversible thermosensitive recording material as claimed in claim 10, wherein a printed portion is provided between said first protective layer and said second protective layer.

12. The reversible thermosensitive recording material as claimed in claim 10, wherein said first protective layer has a thickness of 0.1 to 20 μm, and said second protective layer has a thickness of 0.001 to 2.0 μm.

13. The reversible thermosensitive recording material as claimed in claim 1, wherein a printed portion is provided between said reversible thermosensitive layer and said protective layer.

14. The reversible thermosensitive recording material as claimed in claim 1, wherein said protective layer has a thickness of 0.1 to 30 μm.

15. An image display method comprising the steps of reversibly recording images and erasing the recorded images on a reversible thermosensitive recording material comprising a support and a reversible thermosensitive recording layer formed thereon, said reversible thermosensitive recording layer comprising a reversible thermosensitive layer which comprises an organic low-molecular weight material and a resin matrix and a protective layer which comprises a heat resistant resin formed thereon and having a scratching intensity of 10 g or more and a coefficient friction of 0.10 or less, which is capable of recording and erasing images repeatedly by utilizing the property thereof that the transparency can be changed reversibly from a transparent state to an opaque state, and vice versa, depending upon the temperature thereof, with the application of heat thereto by use of a thermal head.

* * * * *

UNITED STATES PATENT AND TRADEMARK OFFICE

CERTIFICATE OF CORRECTION

PATENT NO. : 5,158,924
DATED : October 27, 1992
INVENTOR(S) : Yukio Konagaya, et. al.

It is certified that error appears in the above-indentified patent and that said Letters Patent is hereby corrected as shown below:

Column 1, line 29, "thermo-sensitive" should read --thermosensitive --.

Column 5, line 63, "example" should read -- examples --.

Column 7, line 19, "acid.amides" should read -- acid, amides --.

Column 7, line 33, "reflection type" should read -- reflection-type --.

Column 7, line 52, "extend" should read -- extended --.

Column 9, line 27, "comprises" should read -- comprise --.

Column 11, line 36-37, delete "because of the same reason mentioned above".

Column 11, line 53, "R is $(C_2)_n$," should read -- R is $(CH_2)_n$, --.

UNITED STATES PATENT AND TRADEMARK OFFICE

CERTIFICATE OF CORRECTION

PATENT NO. : 5,158,924

DATED : October 27, 1992

INVENTOR(S) : Yukio KONAGAYA, et al

It is certified that error appears in the above-identified patent and that said Letters Patent is hereby corrected as shown below:

Column 12, line 15, "crosslinked", should read -- cross-linked --.

Column 12, line 50-55,

" 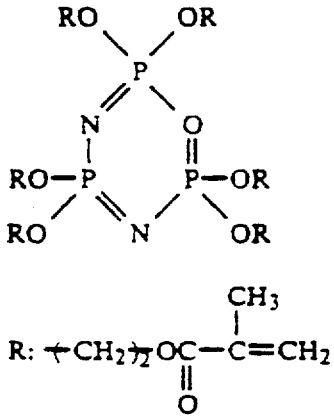 " should read -- 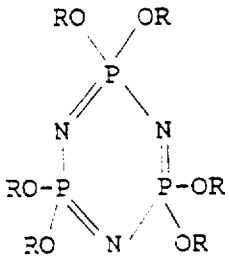 --

UNITED STATES PATENT AND TRADEMARK OFFICE

CERTIFICATE OF CORRECTION

PATENT NO. : 5,158,924

DATED : October 27, 1992

INVENTOR(S) : Yukio KONAGAYA, et al

It is certified that error appears in the above-identified patent and that said Letters Patent is hereby corrected as shown below:

Column 24, line 19, "comprising a", should read -- comprising an --.

Signed and Sealed this

Eleventh Day of January, 1994

Bruce Lehman

*Attest:*

BRUCE LEHMAN

*Attesting Officer*

*Commissioner of Patents and Trademarks*